US006697781B1

(12) United States Patent
Sahlberg

(10) Patent No.: US 6,697,781 B1
(45) Date of Patent: Feb. 24, 2004

(54) METHOD AND APPARATUS FOR GENERATING SPEECH FROM AN ELECTRONIC FORM

(75) Inventor: William H. Sahlberg, Standale, MI (US)

(73) Assignee: Adobe Systems Incorporated, San Jose, CA (US)

( * ) Notice: Subject to any disclaimer, the term of this patent is extended or adjusted under 35 U.S.C. 154(b) by 338 days.

(21) Appl. No.: 09/760,687

(22) Filed: Jan. 16, 2001

Related U.S. Application Data

(60) Provisional application No. 60/198,079, filed on Apr. 17, 2000.

(51) Int. Cl.[7] ..... G10L 13/00

(52) U.S. Cl. ..... 704/260; 704/270; 704/271

(58) Field of Search ..... 704/260, 271, 704/270; 434/169, 185

(56) References Cited

U.S. PATENT DOCUMENTS 5,652,828 A * 7/1997 Silverman ..... 704/260
5,732,395 A * 3/1998 Silverman ..... 704/260
5,749,071 A * 5/1998 Silverman ..... 704/260
5,751,906 A * 5/1998 Silverman ..... 704/260
5,832,435 A * 11/1998 Silverman ..... 704/260
5,890,117 A * 3/1999 Silverman ..... 704/260
5,899,975 A * 5/1999 Nielsen ..... 704/260
6,289,312 B1 * 9/2001 Raman ..... 704/270
6,442,523 B1 * 8/2002 Siegel ..... 704/270

OTHER PUBLICATIONS

Debbie Cook, "Surfing Blind: Products to help you 'see' online", Washington Assistive Technology Alliance Bulletin, Summer 1999.*

Catherine Laws and Chieko Asakawa, "IBM Home Page Reader: The Voice of the World Wide Web", Proc. Technology and Persons With Disabilities Conference 1999, California State University, Northridge.*

* cited by examiner

*Primary Examiner*—Susan McFadden
(74) *Attorney, Agent, or Firm*—Fish & Richardson P.C.

(57) ABSTRACT

A speech-generating computer apparatus for generating speech from electronic forms, a method of controlling a computer and a computer-readable media containing program code embodying an application program for performing a method of generating speech. The computer has a speech-generating function and at least one screen reader program. The at least one screen reader program generates human perceptible speech with the speech-generating function. The computer determines if a particular screen reader program is active and initializes an object in a format of a particular screen reader program that is active.

49 Claims, 5 Drawing Sheets

METHOD AND APPARATUS FOR GENERATING SPEECH FROM AN ELECTRONIC FORM

CROSS-REFERENCE TO RELATED APPLICATION

This application claims priority from U.S. provisional patent application Ser. No. 60/198,079, filed on Apr. 17, 2000, the disclosure of which is hereby incorporated herein by reference in its entirety.

FIELD OF THE INVENTION

This invention relates to a computer having a speech-generating function. In particular, the present invention relates to generating speech within an electronic form. However, its to principles could also be applied to other applications such as a database, or the like, in order to make the database generate speech.

BACKGROUND OF THE INVENTION

Screen reader programs, which generate human perceivable speech from text displayed on a computer monitor, have created a level playing field for low vision and blind users of computers when it comes to reading standard text. Historically there has been difficulty using screen readers with electronic forms. Users of screen readers find that they cannot navigate well throughout an electronic form, or cannot tell if a box is checked or not, or what a total of a calculation might be.

In order to overcome this difficulty, it is common to provide specialized forms that tabulate the identity of the field in one column and accept the entry of data in another column. Such substitutes are difficult to use at best, and are often unacceptable to employers because the information entered on this type of form is inconsistent with what sighted coworkers would use. The result is a sense of frustration by the blind or low-visioned user because they are not allowed the same capabilities as their sighted coworkers.

SUMMARY OF THE INVENTION

In order to overcome these difficulties, new technologies such as Microsoft ActiveX controls can further enhance the capabilities of the screen reader. With the use of an ActiveX control, an object can be created for each form field which is interpreted by a speech-generating function of the computer system to generate human recognizable speech for that field. Thereby, when a user enters a particular form field, the computer generates human recognizable speech that instructs the low vision and blind users of the text to be inserted in that field.

One difficulty of including speech within a form is that the form will speak every time it is opened. For sighted users that do not require screen readers, listening to the human perceivable speech generated by the computer system may be viewed as annoying. Therefore, it would be necessary to supply two versions of the same form to an employer, one version for sighted users and another version for low vision and blind users. Another difficulty is that there are numerous screen readers that are commercially available. An electronic form developed for use with one particular screen reader is normally not useful for another screen reader.

The present invention provides a method and apparatus for generating speech from a computer having a speech-generating function that is adapted to work with a variety of electronic forms or applications, preferably any form or application supporting the Microsoft ActiveX technology. It is an object of the present invention to provide form assistance to low vision and blind users without degradation of the forms' visual appearance. Furthermore, the present invention is useful with multiple different screen reader technologies. Most advantageously, the present invention allows one form or ActiveX application to be supplied on a computer system and is useable in an assist mode for assisting low vision and blind users as well as a non-assist mode in order to be unobtrusive to users not requiring assistance.

According to an aspect of the invention, a method of controlling a computer is provided. The computer would have a speech-generating function and at least one screen reader program. At least one screen reader program would generate human perceivable speech with the speech-generating function. According to this aspect, the method includes determining if a particular screen reader program is active and initializing an object in a format of a particular screen reader program that is active.

According to another aspect of the invention, a method of generating speech from electronic form with a computer includes providing at least one electronic form made up of a plurality of fields. The method further includes determining if a particular screen reader program is active and initializing an object in the form of the particular screen reader program that is active.

A speech-generating computer apparatus for generating speech from electronic forms according to another aspect of the invention includes a computer-processing unit. The computer-processing unit is programmed with a speech-generating function and at least one screen reader program. At least one screen reader program generates human perceptible speech with the speech-generating function. The processing unit determines if a particular screen reader program is active. The processing unit initializes an object in a format of a particular screen reader program that is active.

According to yet another aspect of the invention, a computer-readable medium contains program code embodying an application program. According to this aspect of the invention, the program is for performing a method of generating speech of an electronic form with a computer having a speech-generating function and at least one screen reader program. The at least one screen reader program generates human perceptible speech with the speech-generating function of the computer. According to this aspect of the invention, the method includes determining if a particular screen reader program is active and initializing an object in a format of the particular screen reader program that is active.

These and other objects, advantages and features of this invention will become apparent upon review of the following specification in conjunction with the drawings.

DESCRIPTION OF THE PREFERRED EMBODIMENT

Figure 1A:
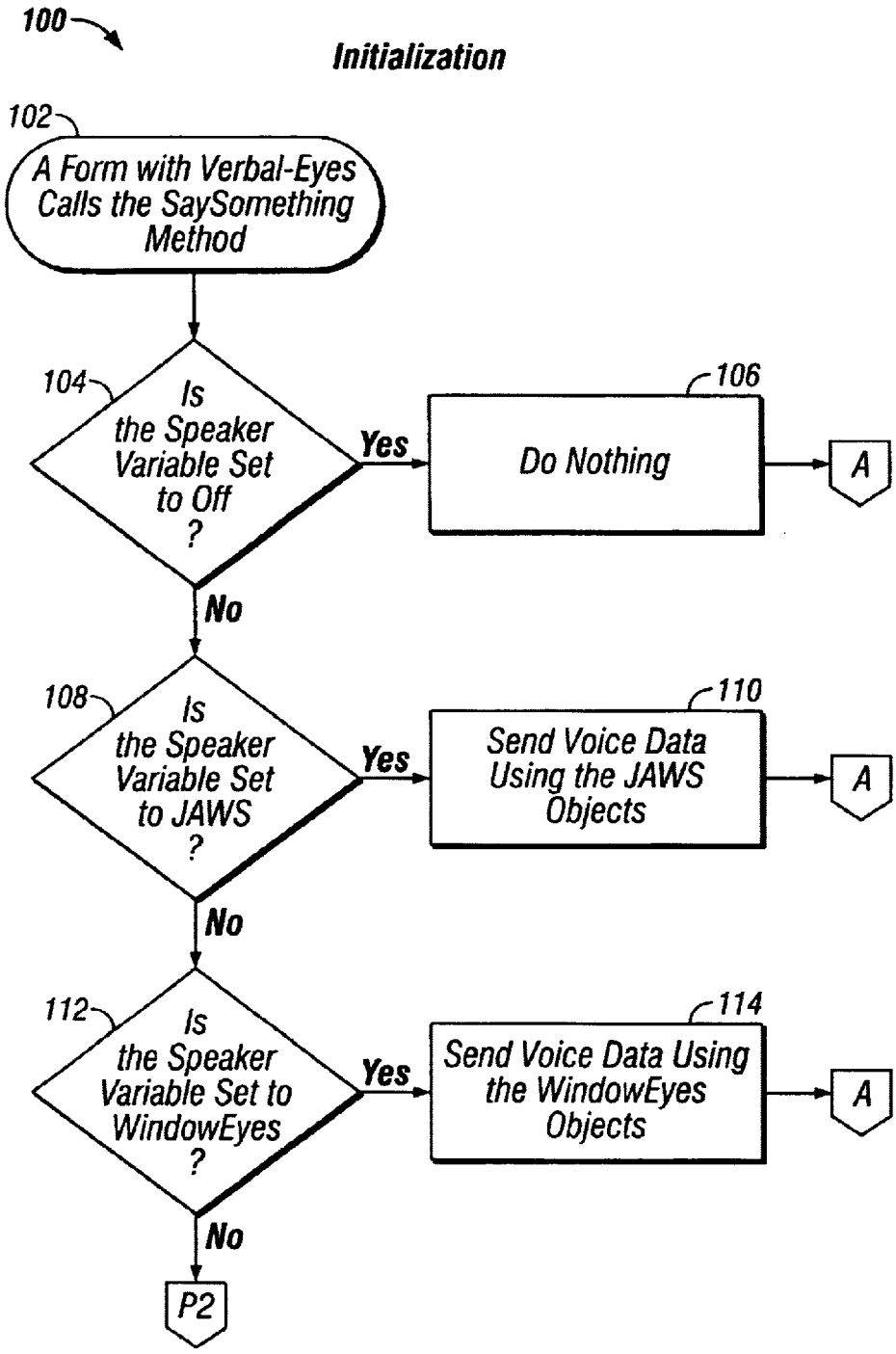
FIGS. 1*a* and 1*b* are a flowchart of an initialization function, according to the invention.

Referring now specifically to the drawings, and the illustrative embodiments depicted therein, in the illustrative embodiment, the present invention is illustrated as operational with a computer such as an IBM compatible personal computer 10 having a central processing unit 12 and, optionally, a monitor 14. Computer 10 further includes at least one audio speaker 18 and a user input device 20. The input device may be a keyboard, a mouse, a microphone, a pointing device, or the like. The invention may be embodied on computer-readable medium 16, such as a diskette or the like, containing program code. At least one screen reader program, capable of generating human perceptible speech with speaker 18, is installed on computer 10. The at least one screen reader program may be one or more commercially available programs, such as Microsoft Speech™ marketed by Microsoft Corporation, Jaws™ marketed by Henter-Joyce, Inc., Advision of Freedom Scientific, Inc. and Window-Eyesυ marketed by GW Micro, Inc. However, other screen readers may be used. Computer 10 may be of the type available from numerous manufacturers and using various processors. The invention is illustrated with such a computer running a Windows 95/98/NT or newer operating system supportive of ActiveX applications. However, this is for illustration purposes only. Other computer system configurations may be utilized with the present invention. Computer 10 may be a standalone computer or a portion of a network, such as a local area network, a wide area network, or a global network such as the Internet.

Figure 1B:
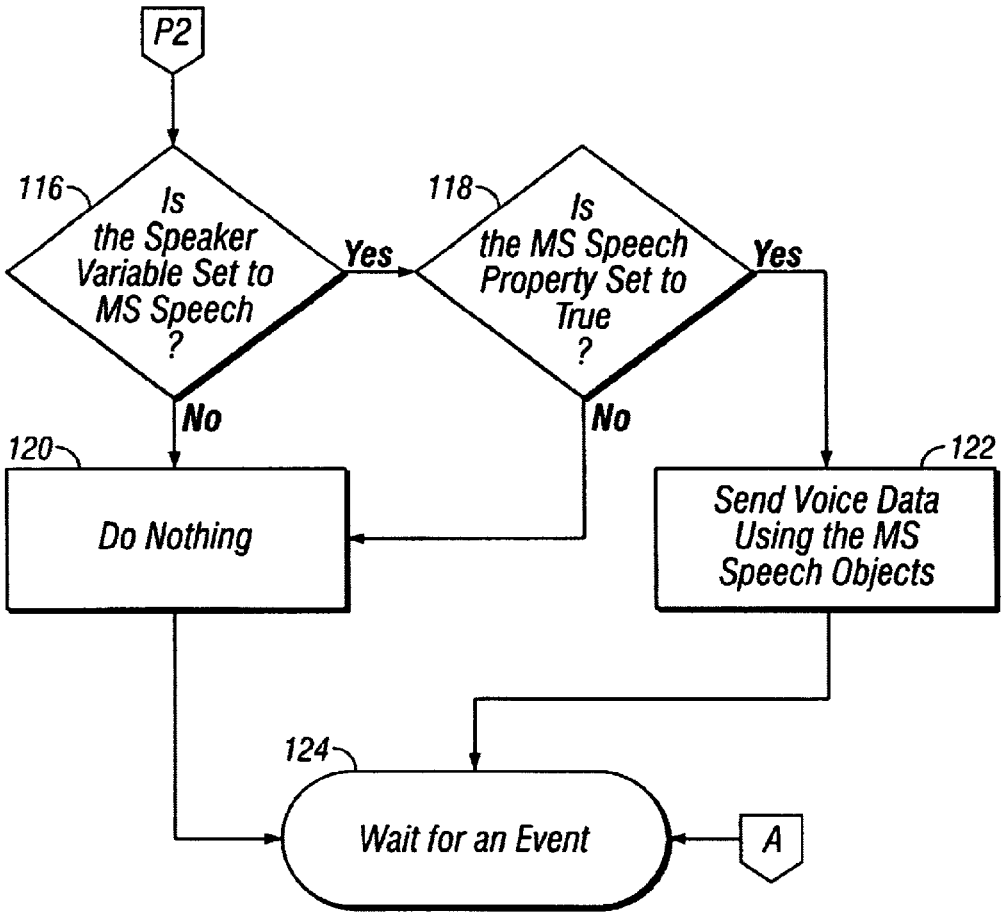
Figure 2:
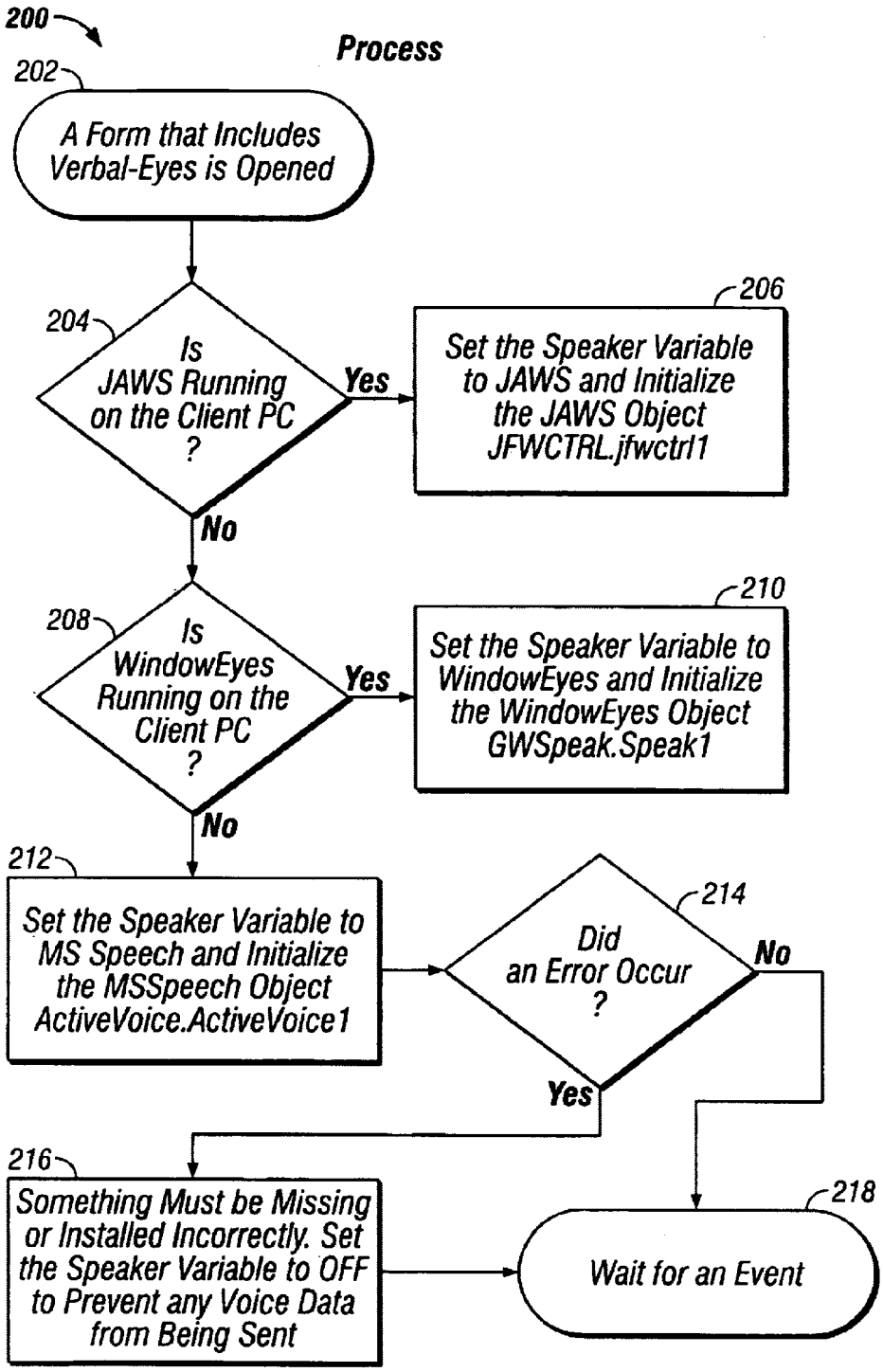
FIG. 2 is a flowchart of a process, according to the invention.
Figure 3:
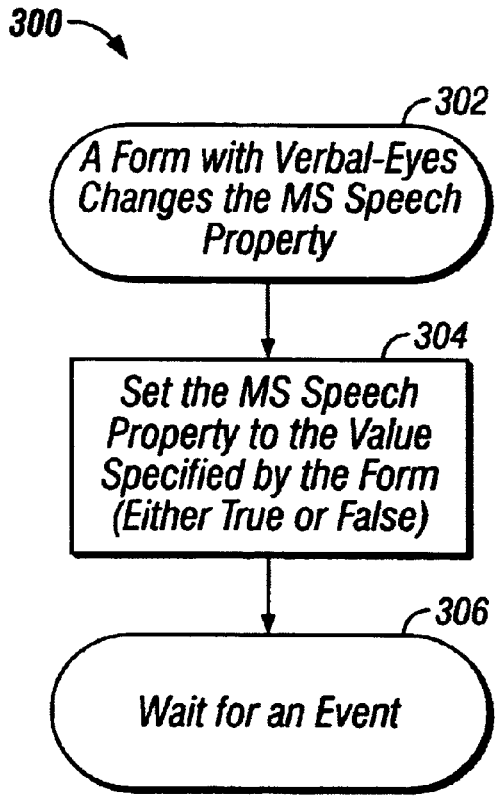
FIG. 3 is a flowchart of a function for turning OFF and ON the Microsoft speech-generating function.
Figure 5:
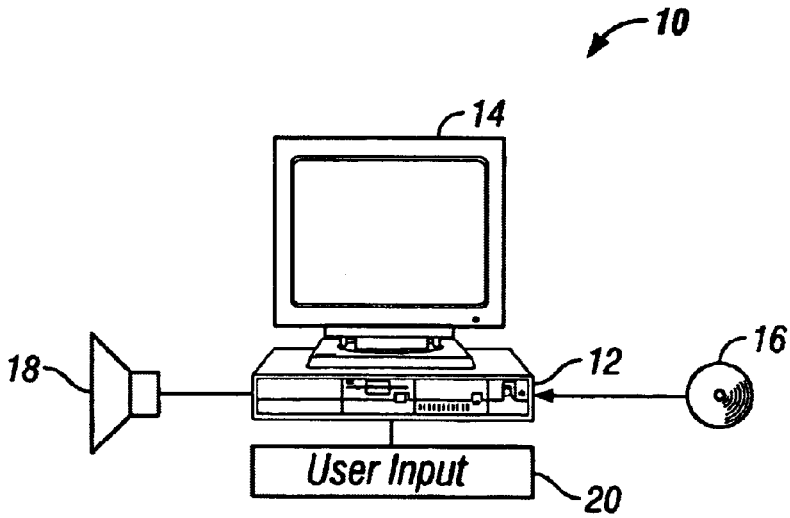
FIG. 5 is a speech-generating computer apparatus and a computer-readable medium containing program code embodying the invention.

The present invention includes an initializing function 100, which determines whether a particular screen reader program is active in the control system (FIGS. 1*a* and 1*b*). In the illustrated embodiment, initialization function 100 is coded in visual basic. However, it could be coded in other languages, such as $C^{++}$, JAVA, and the like. Initialization function 100 is an event-driven program that begins at 102 when the user opens an electronic form. The function then determines at 104 whether a speaker variable, as defined below, has been set to an OFF position. This indicates that the user does not wish to have human recognizable speech generated. If so, the program proceeds to 106 where the speech-generating function is disabled. If it is determined at 104 that the speaker variable is not set to OFF, then it is determined at 108 whether the speaker variable is set to a first particular screen reader program which, in the illustrated embodiment, is the commercially available JAWS program. If it is, then the function sends voice data using objects of that particular screen reader program at 110. If it is determined at 108 that the speaker variable is not set to the first particular screen reader program, then it is determined at 112 whether the speaker variable is set to a second particular screen reader program which, in the illustrated embodiment, is the commercially available Window Eyes program. If the speaker variable is set to the second particular screen reader program, the function sends voice data using objects of the second particular screen reader program at 114. In the illustrative embodiment, function 100 determines if a speaker variable is set to a particular screen reader program by examining the Registry file of the Windows operating system to determine if the particular screen reader program is running, i.e., active.

If it is determined at 108 and 112 that the first and second particular screen reader programs are not active, then function 100 continues to scroll through all of the commercially available screen reader applications that have been added to initialization program 100. A screen reader application may be added to initialization program 100 whether or not that application is loaded on the particular computer. After initialization program 100 determines whether the speaker variable is set to one of the known screen reader applications, it is then determined at 116 whether the speaker variable is set to a screen reader program native to the Windows operating system for the computer system. In the illustrated embodiment, the screen reader program MS Speech is native to the Windows 2000 operating system. Initialization function 100 determines whether the speaker variable is set to MS Speech. If the MS Speech program is native to the operating system of the computer system, the speech variable will be set to MS Speech and it is then determined at 118 whether an MS Speech property variable has been set to a true state. If the speech property has not been set to true or the speech variable is not set to MS Speech, then speech is not generated at 120. If it is determined at 116 that the speech variable is set to MS Speech and at 118 that the MS Speech property is set to true, then voice data is generated at 122 using the MS Speech object. Function 100 then waits for an event to occur at 124. In the illustrated embodiment, an event is when the user indexes to a field in the form accessed at 102.

When an event occurs at 124, a process 200 is carried out. When the event occurs at 202 (124), the function 200 determines whether the first particular screen reader program, which in the illustrated embodiment is the JAWS program, is running at 204. If the first particular screen reader program is running, the function sets the speakers variable to that of the first particular program and initializes the ActiveX object for that particular screen reader program at 206. Each screen reader program has a particular format in the ActiveX control program. Function 200 formats the ActiveX object for the particular screen reader program. In a similar fashion, function 200 determines at 208 whether a second screen reader program is running on the client PC. If so, then the speaker variable is set at 210 to the second screen reader program and the ActiveX object is formatted for that particular screen reader program.

If it is determined at 204–208 that none of the screen reader applications are running, then the speaker variable is set at 212 to the screen reader program native to the operating system. The function 200 then determines at 214 whether an error occurred. An error occurs, for example, when the user operable input indicates that the user does not wish to have the speech function operable but the speaker variable is set to MS Speech. Also, other functions may occur in the system. For example, if the speaker variable is set to a particular screen reader program, but that screen reader program is not running, then it is determined at 214 that an error did occur. The speaker variable is set to OFF at 216 in order to prevent a voice data from being sent. When it is determined at 214 that an error did not occur, an event is waited for at 218. A user operable input function 300 that may be included with a particular form is started at 302 when the user calls up an electronic form. The function sets the speech property of the screen reader program native to the operating system to the value indicated by the user at 304. In particular, a display is provided to the user to turn the voice data OFF or ON. The voice data is set to OFF if the user does not wish to have human perceivable speech generated and vice versa. The program then waits for an event at 306.

Figure 4:
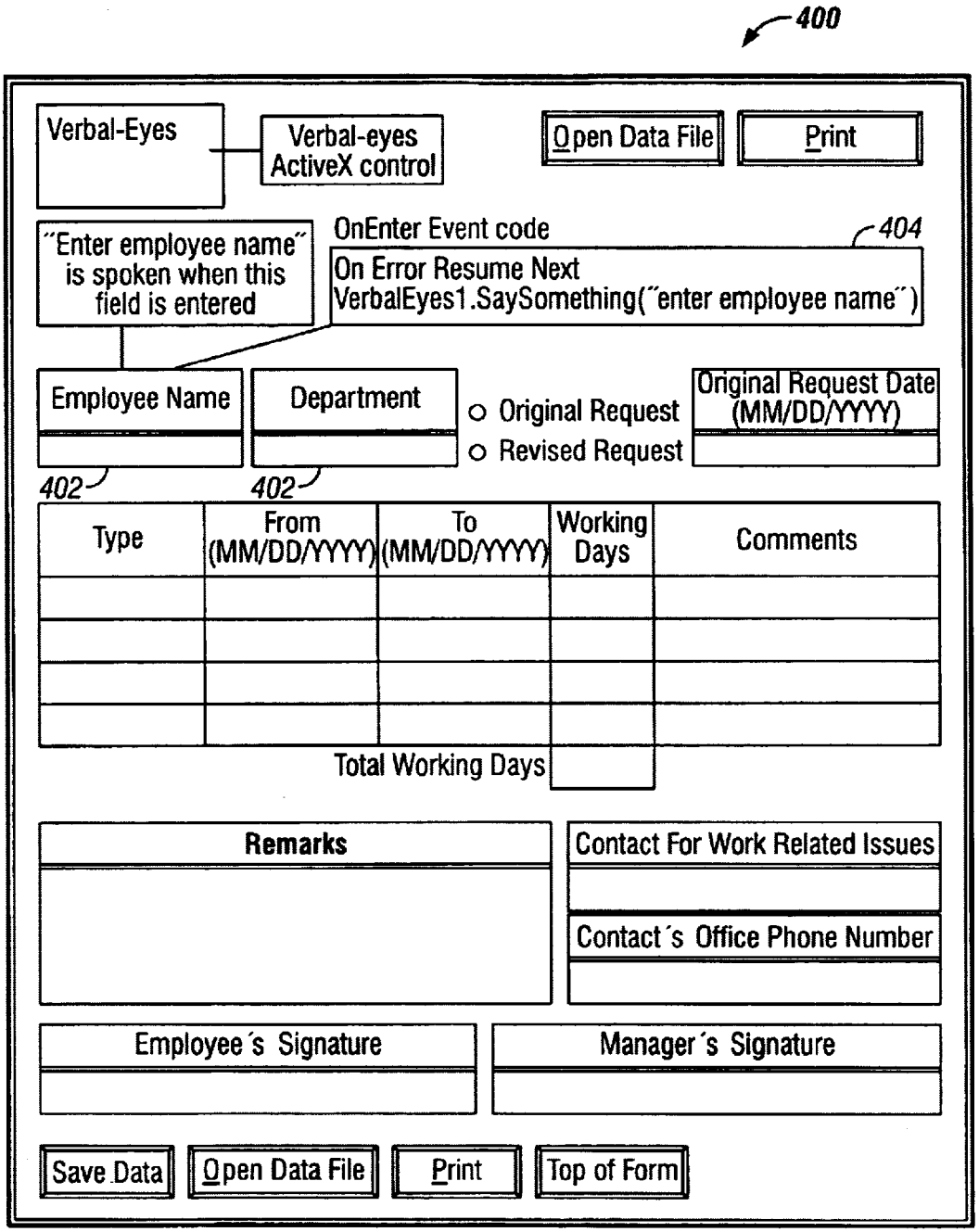
FIG. 4 is an illustration of an electronic form useful with the invention.

An example of an electronic form 400 is illustrated in FIG. 4. The form includes a series of fields 402. An OnEnter or GetFocus Event 404, using the ActiveX control technology, allows a Visual Basic command to speak "enter employee name" to the user. As previously set forth, the present invention formats the event code to the object for the particular screen reader program reading electronic form 400.

The present invention facilitates compliance with regulations such as the Americans With Disability Act (ADA) and proposed Federal legislation Section 508 of the Rehabilitation Act, for accommodating prospective or new employees. This is accomplished in a manner that allows a single form or ActiveX application to be used by blind or sighted employees and does not require obtaining different software for employees requiring assist technology.

Changes and modifications in the specifically described embodiments can be carried out without departing from the principles of the invention which is intended to be limited only by the scope of the appended claims, as interpreted according to the principles of patent law including the doctrine of equivalents.

What is claimed is:

1. A method of controlling a computer having a speech-generating function and at least one screen reader program, wherein said at least one screen reader program generates human perceptible speech with said speech-generating function, said method comprising:

determining if at least one screen reader program from among a plurality of screen reader programs is active; and initializing an object in a format of a particular screen reader program that is active.

2. The method of claim 1 wherein said initializing includes initializing an ActiveX object in a format of a particular screen reader program that is active.

3. The method of claim 1 wherein said plurality of screen reader programs are selected from a group consisting of Microsoft Speech, Jaws and Window Eyes.

4. The method of claim 1 including providing at least one electronic form made up of a plurality of fields.

5. The method of claim 4 including performing said determining when one said at least one electronic form is opened and performing said initializing when one of said fields is entered.

6. The method of claim 1 including setting a speaker variable according to a particular speech reader program being active.

7. The method of claim 6 including providing a user input operable by a user to indicate whether generated speech is desired by a user.

8. The method of claim 7 including setting said speaker variable to an inoperative state if a user indicates with said user input that speech is not desired, wherein speech is not generated.

9. The method of claim 6 including determining that an error has occurred.

10. The method of claim 9 including setting said speaker variable to said inoperative state if an error has occurred.

11. A method of generating speech form an electronic form with a computer having a speech-generating function and at least one screen reader program, wherein said at least one screen reader program generates human perceptible speech with the speech-generating function of the computer, said method comprising:

providing at least one electronic form made up of a plurality of fields;

determining if at least one screen reader program from among a plurality of screen reader programs is active; and initializing an object in a format of a particular screen reader program that is active.

12. The method of claim 11 wherein said initializing includes initializing an ActiveX object in a format of a particular screen reader program that is active.

13. The method of claim 11 including performing said determining when at least one electronic form is opened.

14. The method of claim 13 including performing said initializing when one of said fields is entered.

15. The method of claim 11 wherein said plurality of screen reader programs are selected from a group consisting of Microsoft Speech, Jaws and Window Eyes.

16. The method of claim 11 including setting a speaker variable according to a particular speech reader program being active.

17. The method of claim 16 including providing a user input operable by a user to indicate whether generated speech is desired by the user.

18. The method of claim 17 including setting said speaker variable to an inoperative state if a user indicates with said user input that speech is not desired, wherein speech is not generated.

19. The method of claim 16 including determining that an error has occurred.

20. The method of claim 19 including setting said speaker variable to an inoperative state if an error has occurred.

21. A speech-generating computer apparatus for generating speech from electronic forms, comprising:

a computer processing unit programmed with a speech-generating function and at least one screen reader program, said at least one screen reader program generating human perceptible speech with said speech-generating function;

wherein said processing unit determining if at least one screen reader program from among a plurality of screen reader programs is active; and said processing unit initialing an object in a format of a particular screen reader program that is active.

22. The apparatus of claim 21 wherein said plurality of screen reader programs are selected from a group consisting of Microsoft Speech, Jaws and Window Eyes.

23. The apparatus of claim 21 including at least one electronic form made up of a plurality of fields.

24. The apparatus of claim 21 wherein said processing unit determines if at least one screen reader program is active when said at least one electronic form is opened and initializes said object when one of said fields is entered.

25. The apparatus of claim 21 wherein said processing unit sets a speaker variable according to a particular speech reader program being active.

26. The apparatus of claim 25 including a user input operable by a user to indicate whether generated speech is desired by a user.

27. The apparatus of claim 25 wherein said processing unit sets said speaker variable to an inoperative state if a user indicates with said user input that speech is not desired, wherein speech is not generated.

28. The apparatus of claim 25 wherein said processing unit determines if an error has occurred.

29. The apparatus of claim 28 wherein said processing unit sets said speaker variable to an inoperative state if an error has occurred.

30. The apparatus of claim 21 wherein said processing unit initializes an ActiveX object in a format of a particular screen reader program that is active.

31. A speech-generating computer apparatus for generating speech from an electronic form, comprising:

a computer processing unit programmed with at least one electronic form made up of a plurality of fields, a speech-generating function and at least one screen reader program, said at least one screen reader program capable of generating human perceptible speech from said at least one electric form with said speech-generating function;

wherein said processing unit determining if at least one screen reader program from among a plurality of screen reader programs is active; and said processing unit initializing an object in a format of a particular screen reader program that is active.

32. The apparatus of claim 31 wherein said plurality of screen reader programs are selected from a group consisting of Microsoft Speech, Jaws and Window Eyes.

33. The apparatus of claim 31 wherein said processing unit determines if at least one screen reader program is active when an electronic form is opened and initializes said object when one of said fields is entered.

34. The apparatus of claim 31 wherein said processing unit sets a speaker variable according to a particular speech reader program being active.

35. The apparatus of claim 34 including a user input operable by a user to indicate whether generated speech is desired by the user.

36. The apparatus of claim 35 wherein said processing unit sets said speaker variable to an inoperative state if a user indicates with said user input that speech is not desired, wherein speech is not generated.

37. The apparatus of claim 34 wherein said processing unit determines if an error has occurred.

38. The apparatus of claim 37 wherein said processing unit sets said speaker variable to an inoperative state if an error has occurred.

39. The apparatus of claim 31 wherein said processing unit initializes an ActiveX object in a format of a particular screen reader program that is active.

40. A computer-readable medium containing program code embodying an application program for performing a method of generating speech from an electronic form with a computer having a speech-generating function and at least one screen reader program, wherein said at least one screen reader program generates human perceptible speech with the speech-generating function of the computer, said method comprising:

determining if at least one screen reader program from among a plurality of screen reader pro is active; and initializing an object in a format of a particular screen reader program that is active.

41. The computer-readable medium of claim 40, wherein said plurality of screen reader programs are selected from a group consisting of Microsoft Speech, Jaws and Window Eyes.

42. The computer-readable medium of claim 40, wherein the method further comprises providing at least one electronic form made up of a plurality of fields.

43. The computer-readable medium of claim 42, wherein the method further comprises performing said determining when one said at least one electronic form is opened and performing said initializing when one of said fields is entered.

44. The computer-readable medium of claim 40, wherein the method further comprises setting a speaker variable according to a particular speech reader program being active.

45. The computer-readable medium of claim 44, wherein the method further comprises providing a user input operable by a user to indicate whether generated speech is desired by a user.

46. The computer-readable medium of claim 45, wherein the method further comprises setting said speaker variable to an inoperative state if a user indicates with said user input that speech is not desired, wherein speech is not generated.

47. The computer-readable medium of claim 44, wherein the method further comprises determining that an error has occurred.

48. The computer-readable medium of claim 47, wherein the method further comprises setting said speaker variable to said inoperative state if an error has occurred.

49. The computer-readable medium of claim 40, wherein said initializing includes initialing an ActiveX object in a format of a particular screen reader program that is active.

* * * * *

UNITED STATES PATENT AND TRADEMARK OFFICE

CERTIFICATE OF CORRECTION

PATENT NO. : 6,697,781 B1
DATED : February 24, 2004
INVENTOR(S) : William H. Sahlberg It is certified that error appears in the above-identified patent and that said Letters Patent is hereby corrected as shown below:

Column 6,
Line 7, after "when" please insert -- said --;

Column 8,
Line 5, please delete "pro" and insert -- programs --.

Signed and Sealed this

Eighteenth Day of May, 2004

JON W. DUDAS
*Acting Director of the United States Patent and Trademark Office*